US008517520B2

(12) United States Patent
Nakamura

(10) Patent No.: US 8,517,520 B2
(45) Date of Patent: Aug. 27, 2013

(54) LIQUID JETTING APPARATUS

(75) Inventor: Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 680 days.

(21) Appl. No.: 12/625,916

(22) Filed: Nov. 25, 2009

(65) Prior Publication Data

US 2010/0128093 A1 May 27, 2010

(30) Foreign Application Priority Data

Nov. 27, 2008 (JP) ..... 2008-302530

(51) Int. Cl.
*B41J 2/175* (2006.01)
*B41J 2/17* (2006.01)

(52) U.S. Cl.
USPC ..... 347/85; 347/84

(58) Field of Classification Search
USPC ..... 347/84, 85
See application file for complete search history.

(56) References Cited

U.S. PATENT DOCUMENTS

2005/0195252 A1* 9/2005 Ishikawa et al. ..... 347/84
2007/0146445 A1 6/2007 Nukui et al.

FOREIGN PATENT DOCUMENTS

JP 4129751 4/1992
JP 2005-35033 2/2005
JP 2007-176068 7/2007

* cited by examiner

*Primary Examiner* — Jannelle M Lebron
(74) *Attorney, Agent, or Firm* — Frommer Lawrence & Haug LLP

(57) ABSTRACT

A liquid jetting apparatus includes a liquid jetting head which reciprocates in a first direction along a first plane and jets a liquid, liquid supply sources which stores the liquid, a plurality of flexible tubes each of which constructs a part of a liquid flow passage from one of the liquid supply sources to the liquid jetting head, which are fixed to the liquid jetting apparatus at predetermined fixed portions which are different from connecting portions of the tubes at which the tubes are connected to the liquid jetting head respectively, and which are arranged in a state that the tubes are bent and twisted at portions between the connecting portions and the fixed portions, respectively; and a regulating member which is arranged to regulate movement of the tubes caused by bending of the tubes and which has a facing surface facing the tubes.

11 Claims, 10 Drawing Sheets

LIQUID JETTING APPARATUS

CROSS REFERENCE TO RELATED APPLICATION

The present application claims priority from Japanese Paten Application No. 2008-302530, filed on Nov. 27, 2008, the disclosure of which is incorporated herein by reference in its entirety.

BACKGROUND OF THE INVENTION

1. Field of the Invention

The present invention relates to a liquid jetting apparatus jetting a liquid from nozzles.

2. Description of the Related Art

As one example of a liquid jetting apparatus jetting a liquid from nozzles, in an image recording apparatus disclosed in US Patent Application Publication No. 2007/0146445A1 (corresponding to Japanese Patent Application Laid-open No. 2007-176068), an ink-jet head which reciprocates in a scanning direction and jets ink from nozzles and, ink cartridges which are provided in the apparatus body are connected via a plurality of tubes having flexibility. The tubes are independent from one another and are disposed in a bent state to be allowed to follow the movement of the ink-jet head. Further, one ends of the tubes are connected to the ink-jet head respectively in a state that the tubes are arranged in a direction perpendicular to a vertical direction and the scanning direction, and the tubes are fixed at predetermined fixed portions, which are located at intermediate portions thereof and of which positions in the direction perpendicular to the scanning direction are different from those of the one ends connected to the ink-jet head, in a state that the tubes are arranged in the vertical direction, thereby being in a twisted state.

Further, in this image recording apparatus, a restricting wall is disposed on an outer peripheral side of a bending direction of the tubes in a plane view. The restricting wall faces to portions of the tubes extending from the fixed portions toward a side of the ink-jet head, and the restricting wall extends in the vertical direction. Reaction forces which intend to restore the tubes from the bent state to their original state are generated in the tubes disposed in a bending manner as described above, and when a space for the tubes to return to their original state is secured in an apparatus body, a size of the apparatus body is increased. Thus, the restricting wall is provided in order to prevent a size of the apparatus body from being increased, and the movement of the tubes is restricted when the tubes come into contact with the restricting wall, resulting that returning of the tubes to their original state by the above-described reaction forces is prevented.

SUMMARY OF THE INVENTION

Here, in the image recording apparatus disclosed in US Patent Application Publication No. 2007/0146445A1, when the ink-jet head repeats the reciprocation in the scanning direction, movements of the tubes to come into contact with the restricting wall and movements of the tubes to leave the restricting wall are repeated alternately. When the tubes come into contact with the restricting wall, the tubes collide with the restricting wall, thereby generating noises. However, in the image recording apparatus disclosed in US Patent Application Publication No. 2007/0146445A1, the tubes are disposed in the twisted state as described above, and therefore an arrangement direction of the tubes at portions between the ink jet head and the fixed portions inclines from the vertical direction. Accordingly, separation distances between the respective tubes and the restricting wall are different from one another, and timings in which the respective tubes come into contact with the restricting wall are also different from one another. As a result, a period of time in which the noises are generated caused by the tubes coming into contact with the restricting wall becomes long.

An object of the present invention is to provide a liquid jetting apparatus enabling a period of time in which the noises caused by the tubes coming into contact with a regulating member to be short.

According to a first aspect of the present invention, there is provided a liquid jetting apparatus which jets a liquid, including: a liquid jetting head which reciprocates in a first direction on a first plane and which jets the liquid from a nozzle; liquid supply sources which store the liquid to supply to the liquid jetting head; a plurality of flexible tubes each of which constructs a part of a liquid flow passage from, one of the liquid supply sources to the liquid jetting head, which are fixed to the liquid jetting apparatus at predetermined fixed portions which are different from connecting portions of the tubes at which the tubes are connected to the liquid jetting head respectively, which are arranged in a state that the tubes are bent and twisted at portions between the connecting portions and the fixed portions, and which have extending portions extending from the fixed portions to the portions at which the tubes are bent and twisted respectively; and a regulating member which is arranged to regulate movement of the tubes caused by bending of the tubes and which has a facing surface facing the extending portions of the tubes and extending in the first direction, wherein the facing surface has a first end portion which is located in the vicinity of the fixed portions of the tubes and a second end portion which is opposite to the first end portion in the first direction, the facing surface regulates the movement of the tubes in a second direction perpendicular to the first direction on the first plane, the tubes are arranged along a second plane which is intersecting with the first plane in the vicinity of the second end portion, and the facing surface inclines in the vicinity of the second end portion with respect to a direction perpendicular to the first plane such that the facing surface is parallel to the second plane in the vicinity of the second end portion, In the case in which the tubes are disposed in the twisted state, the arrangement direction of the tubes at the portions facing to the facing surface of the regulating member inclines from the arrangement direction at the fixed portions to the largest extent at the portions of the tubes facing the second end portion of the facing surface. According to the first aspect of the present invention, the second end portion of the facing surface of the regulating member inclines from the arrangement direction of the tubes at the fixed portions to be parallel to the arrangement direction of the tubes at the portions facing to the second end portion. Therefore, there are no differences in separation distances between the respective tubes and the facing surface, and timings in which the tubes come into contact with the facing surface with the movement of the liquid jetting head are the same. Accordingly, compared with the case in which the contact timings of the tubes with the regulating member are different from one another, a period of time when noises are generated by the contact between the tubes and the facing surface can be made short.

BRIEF DESCRIPTION OF THE DRAWINGS

FIG. 2 is viewed from a direction of an arrow III in FIG. 2;

DETAILED DESCRIPTION OF THE PREFERRED EMBODIMENTS

Figure 1:
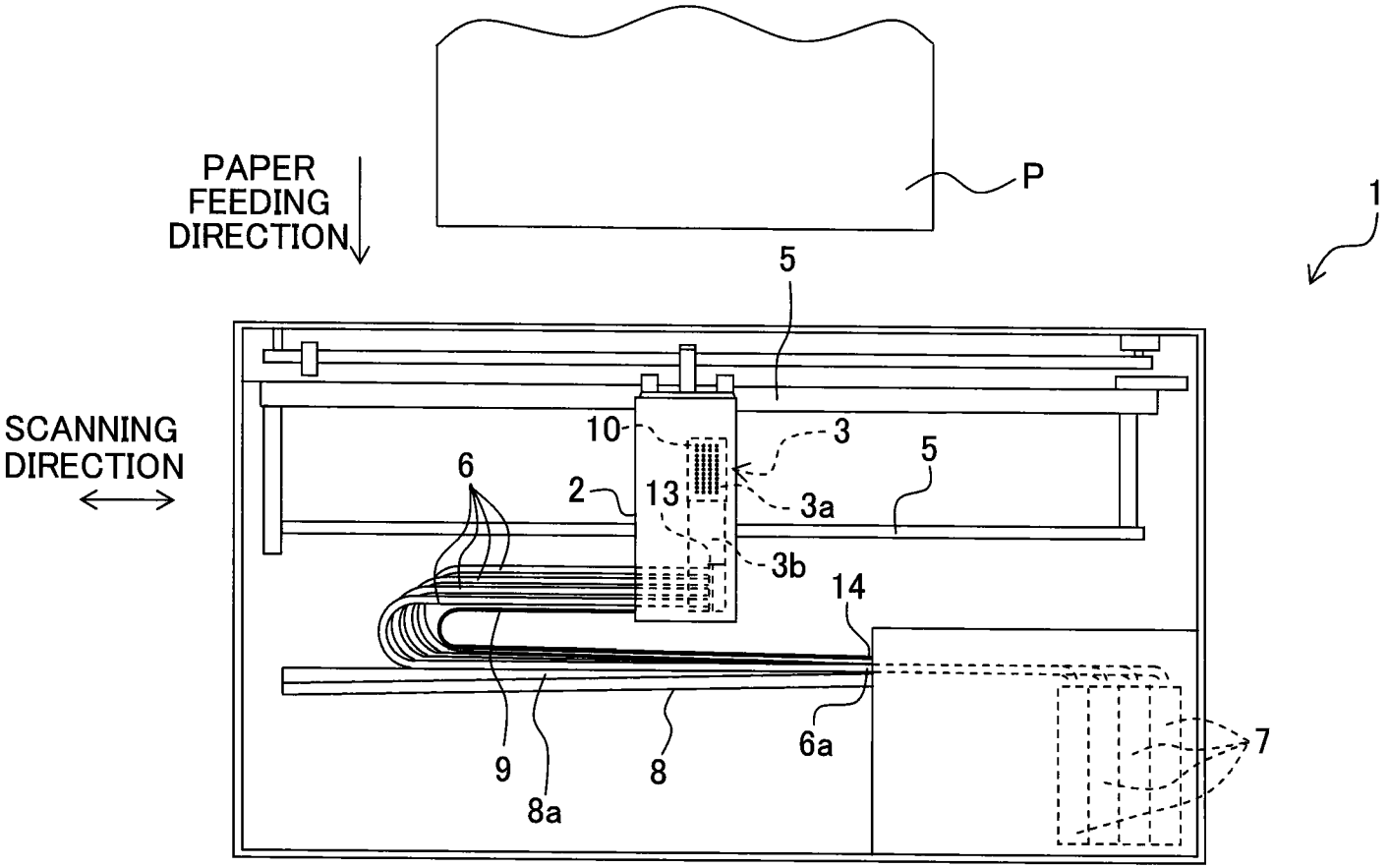
FIG. 1 is a schematic structural view of a printer according to an embodiment in the present invention.
Figure 2:
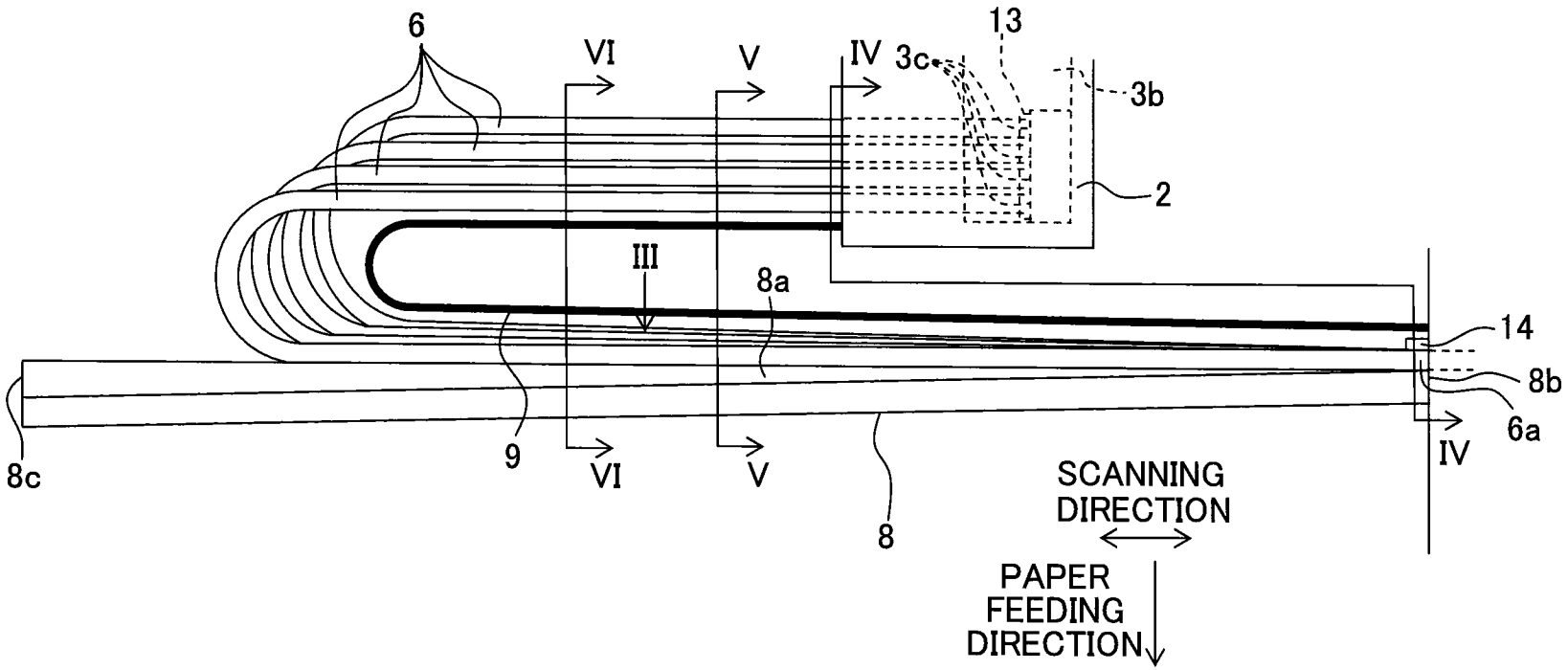
FIG. 2 is a partially enlarged view of an area near the tubes in FIG. 1.

Hereinafter, a preferred embodiment of the present invention will be explained.

As shown in FIG. 1 to FIG. 6, a printer 1 (a liquid jetting apparatus) is provided with a carriage 2, an ink-jet head 3 (a liquid jetting head), four tubes 6, four ink cartridges 7, a tube guide 8 (a regulating member), a flexible flat cable (FFC) 9, and so on.

The carriage 2 is moved to reciprocate in a scanning direction (a right and left direction in FIG. 1, a first direction) parallel to a horizontal plane (a first plane) along two guide shafts 5 disposed parallel to each other. The ink-jet head 3 has a head body 3*a* and a sub-tank unit 3*b*. The head body 3*a* is disposed on a lower surface of the carriage 2 and jets ink from nozzles 10 formed on a lower surface of the head body 3*a*.

In the sub-tank unit 3*b*, sub-tanks (not shown) for temporarily storing ink to be supplied to the head body 3*a*, ink channels (not shown) connected to the sub-tanks, and so on are formed, and the sub-tank unit 3*b* is connected to the head body 3*a* and extends downward in FIG. 1 from a portion connected to the head body 3*a*. Further, in the sub-tank unit 3*b*, four connecting ports 3*c* arranged along a paper feeding direction (an up and down direction in FIG. 1, a direction parallel to the horizontal plane and perpendicular to the first direction, a second direction) are disposed at a lower end portion in FIG. 1. Then, one ends of the tubes 6 are connected to the four connecting ports 3*c* respectively, and thereby ink to be jetted from the nozzles 10 is supplied from the tubes 6 to the ink-jet head 3 as will be described later.

The four ink cartridges 7 (liquid supply sources) are disposed at a right lower end portion of the printer 1 in FIG. 1, and arranged in the scanning direction. In the four ink cartridges 7, inks of black, yellow, cyan, and magenta are stored respectively, and the other ends of the tubes 6 are connected thereto. Thereby, the inks stored in the ink cartridges 7 are supplied to the ink-jet head 3 through the tubes 6.

Then, the printer 1 can perform printing on a recording paper P in a manner that the inks are jetted, from the nozzles 10 of the ink-jet head 3 which is moved in the scanning direction with the carriage 2, onto the recording paper P transported in a paper feeding direction (downward in FIG. 1) by a not-shown paper transporting mechanism.

The tubes 6 are made of a material having flexibility such as, for example, synthetic resin, and a cross section of each of the tubes 6 in a direction perpendicular to an extending direction thereof is made substantially circular.

Further, the tubes 6 have the one ends thereof connected to the connecting ports 3*c* in the ink-jet head 3 as described above, and extend leftward in FIG. 1 from the connecting ports 3*c*. Then, the tubes 6 are curved at approximately 180° and extend rightward in FIG. 1, and have the other ends thereof connected to the ink cartridges 7 as described above. In other words, the respective tubes 6 extend in the scanning direction from fixed portions 6*a*, and are bent back in a U-shape at intermediate portions of the tubes 6 and connected to the connecting ports 3*c* in the ink-jet head 3. Here, the reason why the tubes 6 are disposed in a bent manner as described above is to enable the tubes 6 to follow the ink-jet head 3 when the ink-jet head 3 is moved in the scanning direction with the carriage 2.

Further, at the fixed portions 6*a* positioned between bent portions and the ink cartridges 7 (at portions different from connecting portions to the ink-jet head 3), the tubes 6 are arranged in a vertical direction (a direction intersecting with the predetermined plane) and fixed to be sandwiched between a fixing member 14 and the tube guide 8.

Then, in this manner, the four tubes 6 are connected to the connecting ports 3*c* in a state that the tubes 6 are arranged in the paper feeding direction, and the tubes 6 are fixed at the fixed portions 6*a* in a state that the tubes 6 are arranged in the vertical direction, thereby being in a twisted state.

Here, all of the fixed portions 6*a* of the tubes 6 are positioned below the connecting ports 3*c* in the ink-jet head 3 in. FIG. 1. Further, the fixed portions 6*a* are positioned above the connecting ports 3*c* in the ink-jet head 3 in the vertical direction. In other words, the connecting ports 3*c* in the ink-jet head 3 are positioned below a fixed portion 6*a* positioned at an end on the lowest side of the fixed portions 6*a* of the four tubes 6. Alternatively, the connecting ports 3*c* in the ink-jet head 3 may be disposed as high as the fixed portion 6*a* positioned at the lowest.

Further, the four tubes 6 are fixed at the one ends thereof connected to the connecting ports 3*c* in the ink-jet head 3 in a state that the tubes 6 are bound to one another by a coupling portion 13. This makes it possible to connect the four tubes 6 to the connecting ports 3*c* at a time, and the connection of the tubes 6 to the connecting ports 3*c* can be pawned easily. Note that at portions between the one ends thereof and the fixed portions 6*a*, the four tubes 6 are not bound to (are separated from) one another and can be deformed independently.

Further, the tube 6, which is included in the four tubes 6 and which is positioned more upwardly at the fixed portion 6*a*, is connected to the connecting port 3*c* which is positioned on the inner circumferential side (lower side as viewed in FIG. 1) of the bending of the tubes 6 as viewed in a plan view, i.e., the connecting port 3*c* which is closer to the fixed portion 6*a* in the paper feeding direction (upward-downward direction as viewed in FIG. 1). On the other hand, the four tubes 6 have substantially same lengths in order to make channel resistances of the tubes 6 uniform. Therefore, as shown in FIGS. 1 to 6, the four tubes 6 are arranged so that the tube 6, which is positioned more downwardly, has the.

In the embodiment of the present invention, as described above, the four tubes 6 are separated from each other at the portions disposed between the connecting ports 3*c* and the fixed portions 6*a*, and they are deformable independently. Therefore, even when the lengths of the four tubes 6 are same with each other, the tubes 6 can be arranged in a twisted state so that the tube 6, which has the fixed portion 6*a* positioned more upwardly, is connected to the connecting port 3*c* which is positioned on the inner circumferential side of the bending of the tube 6 as viewed in a plan view, i.e., on the downstream side in the paper feeding direction.

Here, unlike this embodiment, if the connecting ports 3*c* of the ink-jet head 3 are arranged in the vertical direction in conformity with the arrangement of the fixed portions 6*a*, the tubes 6 can be connected to the connecting ports 3*c* without allowing the tubes 6 to be in the twisted state as described above. However, in the above case, a length of the ink-jet head 3 (the sub-tank unit 3*b*) in the vertical direction is increased.

However, in this embodiment, the connecting ports 3*c* of the ink-jet head 3 are arranged in the paper feeding direction. Therefore, it is necessary that the tubes 6 should be in the twisted state as described above in order that the tubes 6, which are arranged in the vertical direction at the fixed portions 6*a* are connected to the connecting ports 3*c* which are arranged in the paper feeding direction. However, it is possible to decrease the length of the ink-jet head 3 in the vertical direction.

The tube guide 8 is made of, for example, a synthetic resin material, and disposed adjacently to a lower side of the tubes 6 in FIG. 1 (the outer peripheral side of a bending direction of the tubes 6 in a plane view). The tube guide 8 extends from a first end portion 8*b* in the vicinity of the fixed portions 6*a* of the tubes 6 to a second end portion 8*c* on a side opposite to the first end portion in the scanning direction. Then, a surface of the tube guide 8 on an upstream side of the paper feeding direction (an upper side in FIG. 1) is made to be a facing surface 8*a* facing to portions of the tubes 6 between the bent portions and the fixed portions 6*a* (extending portions extending from the fixed portions to the portions at which the tubes are bent and twisted), and the above-described portions of the tubes 6 come into contact with the facing surface 8*a*. Accordingly, the tubes 6 are regulated for the spread which would be otherwise caused such that the portions of the tubes 6 opposed to the opposing surface 8*a* are moved downwardly as viewed in FIG. 1 (in the direction perpendicular to the first direction and parallel to the predetermined plane) by the reaction forces F1 to F4 generated by the bending of the tubes 6 as described later on. Note that contact areas of the respective tubes 6 with the facing surface 8*a* in the scanning direction become greater as the ink-jet head 3 comes closer to an end portion on a side of the second end portion 8*c* of the tube guide 8 in a moving range in the scanning direction.

Figure 5:
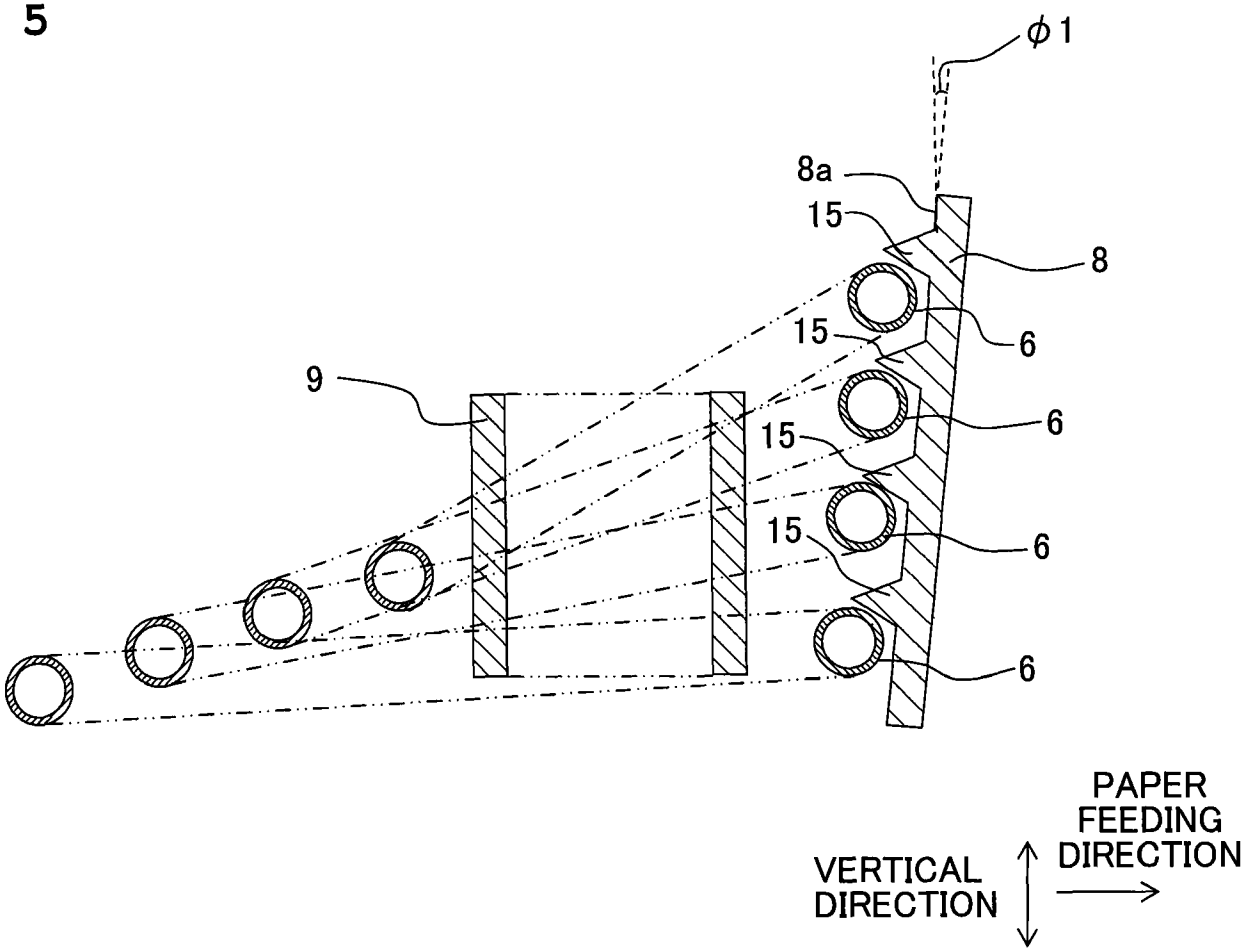
FIG. 5 is a cross-sectional view taken along a line V-V in FIG. 2.
Figure 6:
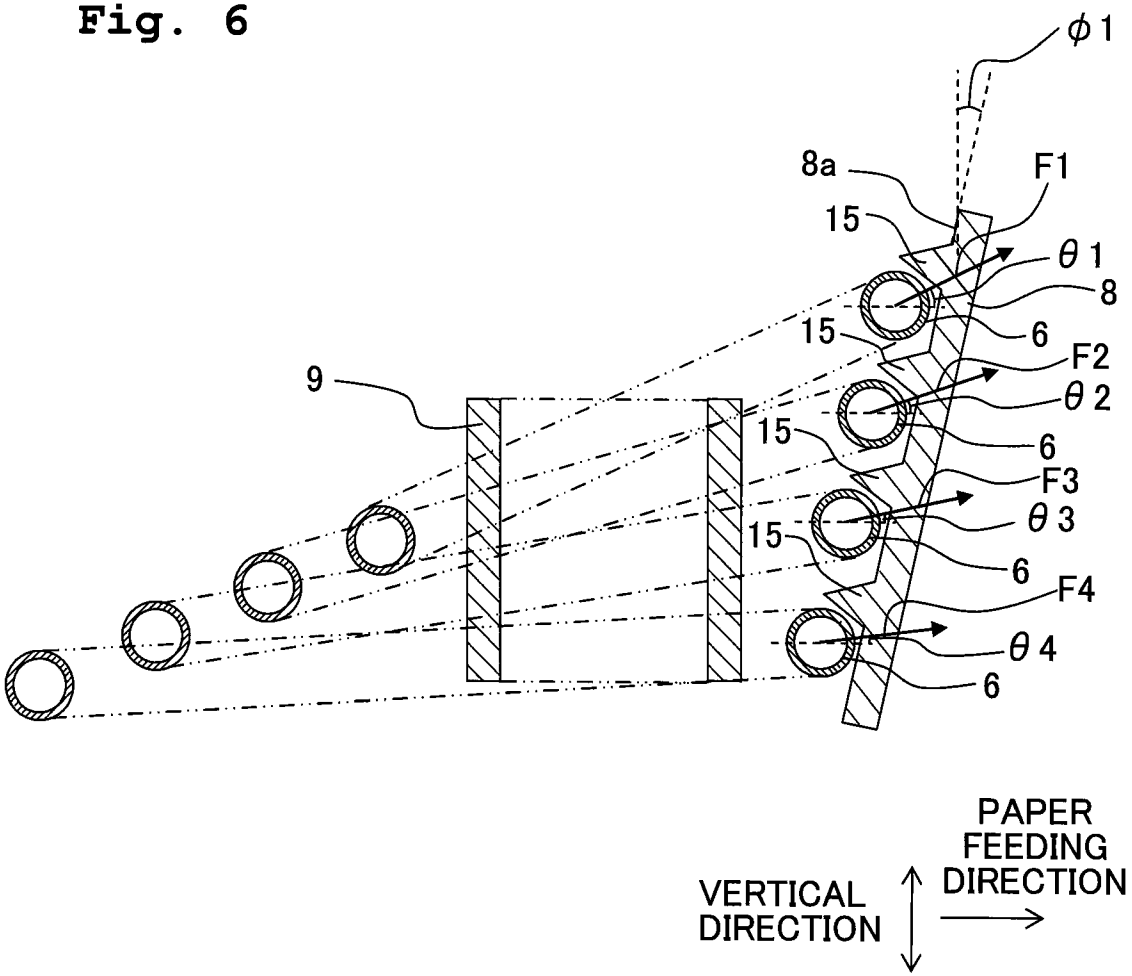
FIG. 6 is a cross-sectional view taken along a line VI-VI in FIG. 2.

Further, in the case when seen from the side of the second end portion 8*c* of the tube guide 8, as shown in FIG. 5 and FIG. 6, the facing surface 8*a* is made to be a curved surface such that a clockwise inclination angle $\phi$1 with respect to the vertical direction (the arrangement direction of the tubes 6 at the fixed portions 6*a*) increases toward the second end portion 8*c*, and the facing surface 8*a* inclines in a manner that an upper end thereof is positioned on a downstream side of the paper feeding direction (the right side in FIG. 5) with respect to a lower end thereof at any portion in the scanning direction.

Here, as described above, the four tubes 6 are connected to the, connecting ports 3*c* of the ink-jet head 3 in a state that the tubes 6 are arranged in the paper feeding direction, and the tubes 6 are fixed at the fixed portions 6*a* in a state that the tubes 6 are arranged in the vertical direction to be in the twisted state. Therefore, the four tubes 6 are arranged so that as a tube 6 is positioned more upwardly in the vertical direction at a portion facing the facing surface 8*a*, the tube 6 is positioned on the more downstream side in the paper feeding direction (the right side in FIG. 5 and FIG. 6), in other words, on the more outer circumferential side of the bending of the tubes 6. Further, an inclination angle of the arrangement direction of the four tubes 6 with respect to the vertical direction increases from the fixed portions 6*a* toward the bending portions thereof in the scanning direction.

Figure 3:
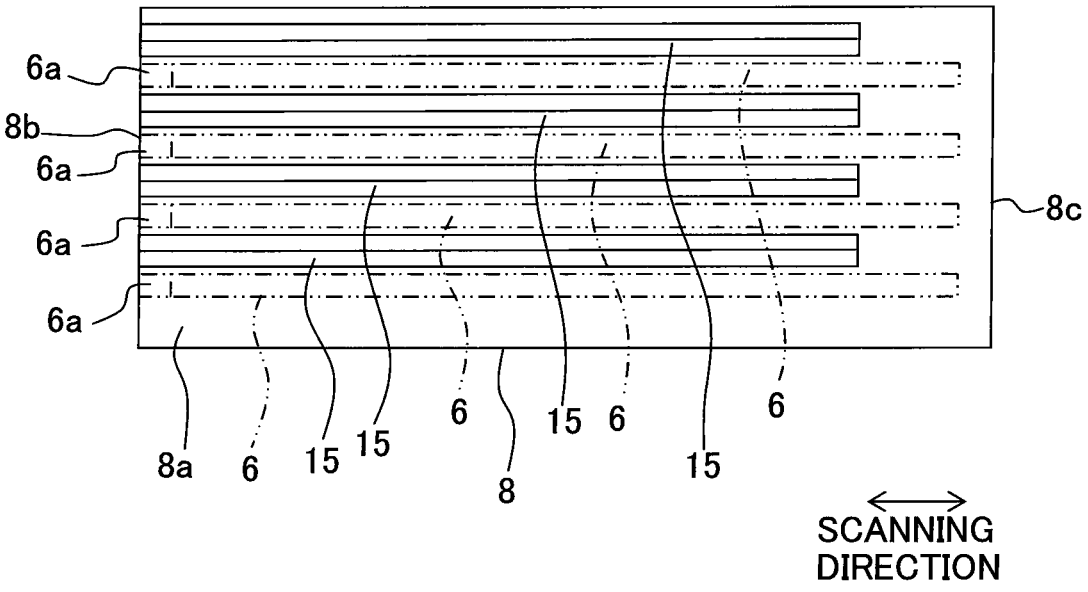
FIG. 3 is a view when

Then, since the facing surface 8*a* is made to be the curved surface as described above, the facing surface 8*a* inclines with respect to the vertical direction to be substantially parallel to the arrangement direction of the four tubes 6 along a whole area thereof including the second end portion 8*c* (a right end portion in FIG. 3).

Figure 4:
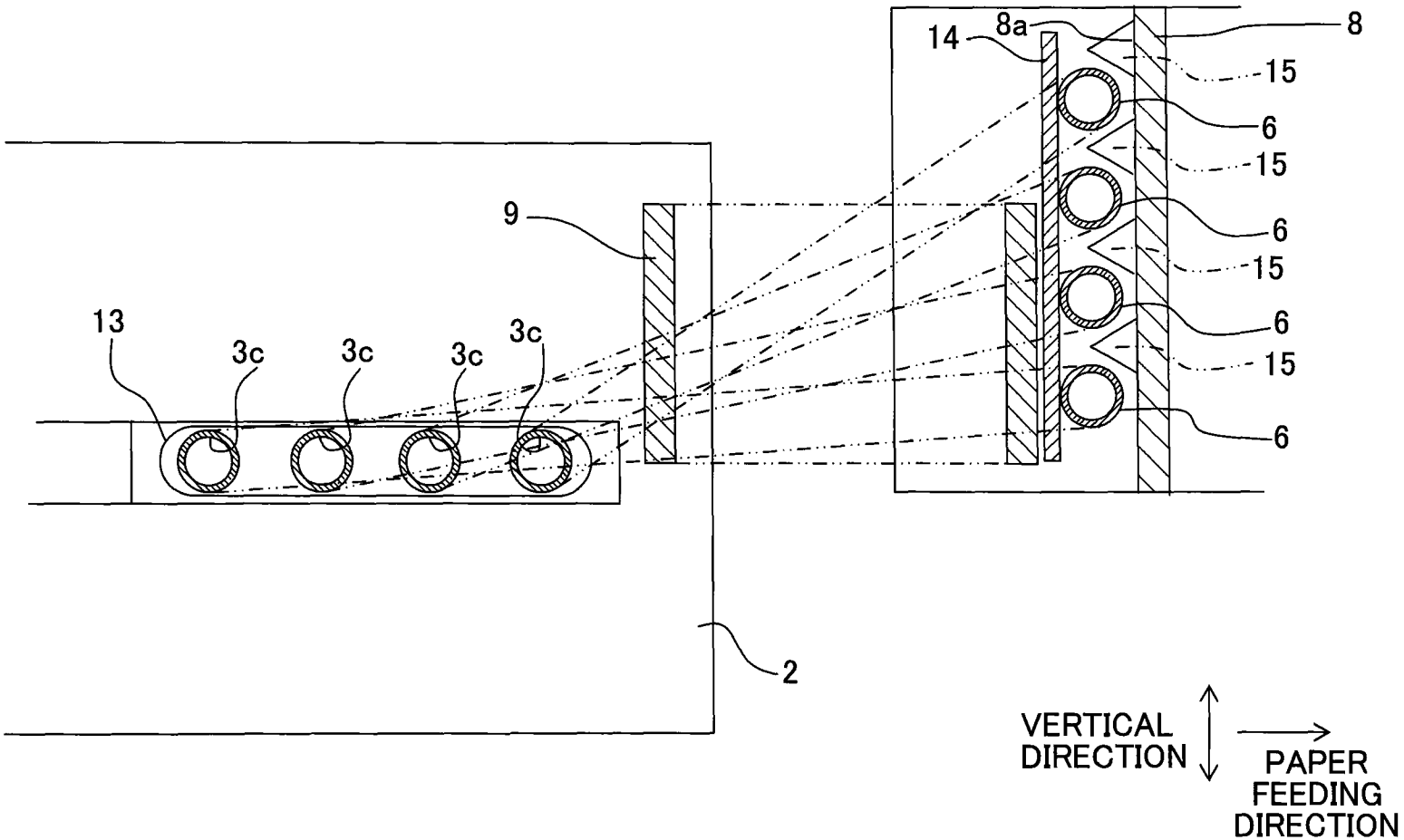
FIG. 4 is a cross-sectional view taken along a line IV-IV in FIG. 2.

Further, four ribs 15 are formed on the facing surface 8*a* of the tube guide 8 correspondingly to the four tubes 6. As shown in FIG. 4, the ribs 15 project from the facing surface 8*a* toward the upstream side of the paper feeding direction respectively, and the ribs 15 are formed in a tapered shape in a manner that lengths thereof in the vertical direction decreases toward the upstream side of the paper feeding direction. The four ribs 15 project from the facing surface 8*a* toward the upstream side of the paper feeding direction at portions above the fixed portions 6*a* of the four tubes 6 in the vertical direction respectively, and thereby, floating of the tubes 6 is prevented. Note that the tube guide 8 on which the ribs 15 as described above are formed can be formed by resin molding or the like.

In this manner, each of the ribs 15 has the tapered shape in which the width in the vertical direction is decreased toward the upstream side of the paper feeding direction. Therefore, it is enough for the ribs 15 that the spacing distances, which are provided at least in the vicinity of end portions to be brought in contact with the tubes 6, are larger than the diameters of the tubes 6. It is enough that the spacing distances between the ribs 15, which are provided on the opposing surface 8*a*, are smaller than the diameters of the tubes 6. Accordingly, it is possible to decrease the spacing distances between the ribs 15. It is possible to prevent the tube guide 8 from being large-sized.

Here, when the tubes 6 move in accordance with repeating of the reciprocation of the ink-jet head 3 in performing printing in the printer 1, a movement of the tubes 6 which are away from the facing surface 8*a* to come into contact with the facing surface 8*a* and a movement of the tubes 6 which are in contact with the facing surface 8*a* to leave the facing surface 8*a* are repeated alternately, and when the tubes 6 come into contact with the facing surface 8*a*, the tubes 6 collide with the facing surface 8*a*, thereby generating noises.

On the other hand, the arrangement direction of the four tubes 6 inclines with respect to the vertical direction as described above. Therefore, if the facing surface 8*a* extends in the vertical direction all along a whole area thereof unlike this embodiment, distances between the respective tubes 6 and the facing surface 8*a* are different from one another. As a result, timings in which the respective tubes 6 come into contact with the facing surface 8*a*, in other words, timings in which the respective tubes 6 collide with the facing surface 8*a*, thereby generating noises are different from one another, and a period of time when the above-described noises are generated becomes long.

On the other hand, in this embodiment, as described above, the facing surface 8*a* is made to be the curved surface in which the inclination extent with respect to the vertical direction increases toward the second end portion 8*c* in the scanning direction, and the facing surface 8*a* is made to be substantially parallel to the arrangement direction of the four tubes 6 in an entire area of the facing surface 8*a*. Accordingly, there are no differences between separation distances between the respective tubes 6 and the facing surface 8*a*, and the four tubes 6 come into contact with the facing surface 8*a* at substantially the same time. Consequently, the timings, in which the respective tubes 6 collide with the facing surface 8*a* and thereby generating noises, are substantially the same, and the period of time when the above-described noises are generated is short.

Further, since the four tubes 6 are bent at the portions between the connecting ports 3*c* and the fixed portions 6*a* as described above, the reaction forces F1 to F4 which intend to restore the tubes 6 from the bent state to their original state are generated in the tubes 6 respectively. Then, since the connecting ports 3*c* in the ink-jet head 3 to which the one ends of the tubes 6 are connected and the fixed portions 6*a* of the tubes 6 are positioned at heights different from each other in this embodiment, the above-described reaction forces F1 to F4 act not only in the direction parallel to the horizontal plane but also in the vertical direction.

On the other hand, in the printer 1 performing printing by jetting the inks from the nozzles 10 in the ink-jet head 3, when printing on the large recording paper P is desired to be achieved, for example, it is necessary to increase amounts of the inks to be supplied to the ink-jet head 3. However, in order to achieve the above, it is necessary to make the diameters of the tubes 6 large.

Then, when the diameters of the tubes 6 are made large, the above-described reaction forces F1 to F4 are also made large, and thereby there is a risk that the tubes 6 float along the facing surface 8*a* (move in a direction intersecting with the predetermined plane).

However, since the ribs 15 are formed on the facing surface 8*a* of the tube guide 8 on which the tubes 6 abut, in this embodiment, it is possible to prevent (restrict) the floating of the tubes 6 when the tubes 6 come into contact with the ribs 15.

At this time, unlike this embodiment, even when only the rib 15 positioned uppermost of the four ribs 15 is provided, it is possible to prevent the floating of the tubes 6 as described above. However, in the above case, at the portions between the connecting ports 3*c* and the fixed portions 6*a*, the four tubes 6 are not fixed to one another and can be deformed independently. Accordingly, angles θ1 to θ4 of the reaction forces F1 to F4 with respect to the horizontal plane are different as shown in FIG. 6 respectively, and vertical components of the reaction forces F1 to F4 are different from one another, and amounts in which the four tubes 6 float are also different from one another. As a result, there is a risk that the tubes 6 are tangled with one another.

On the other hand, in this embodiment, since the ribs 15 are individually provided correspondingly to the four tubes 6, the four tubes 6 come into contact with the corresponding ribs 15 respectively, and this makes it possible to prevent the tubes 6 from floating and to prevent the tubes 6 from being tangled with one another.

The FFC 9 is provided to apply a driving potential and the like to the ink-jet head 3, and is disposed adjacently to the tubes 6 on the inner peripheral side of the bending of the tubes 6 in a plane view, and extends in a state that the FFC 9 is bent along the tubes 6.

According to this embodiment explained above, the four tubes 6 are connected to the connecting ports 3*c* in the ink-jet head 3 in a state that the tubes 6 are arranged in the paper feeding direction, and are fixed to the tube fuide 8 at the fixed portions 6*a* which are located at positions different from that of the connecting ports 3*c* in the paper feeding direction and at which the tubes 6 are arranged in the vertical direction. Therefore, the inclination extent of arrangement direction of the four tubes 6 with respect to the vertical direction at the portions of the tubes 6 facing the facing surface 8*a* of the tube guide 8 increases toward the portions at which the tubes 6 are bent and twisted. However, the facing surface 8*a* of the tube guide 8 is made to be the curved surface such that the inclination extent of the facing surface 8*a* with respect to the vertical direction increases toward the second end portion 8*c* in the scanning direction, namely as it goes farther from the first end portion 8*b*, and the facing surface 8*a* is made substantially parallel to the arrangement direction of the four tubes 6 in the entire area of the facing surface 8*a*. Therefore, there are no differences between the separation distances between the respective tubes 6 and the facing surface 8*a*, and the four tubes 6 come into contact with the facing surface 8*a* at substantially the same time. Accordingly, the timings in which the respective tubes 6 collide with the facing surface 8*a* and thereby generating noises are substantially the same, and the period of time when the above-described noises are generated becomes short.

Further, since the ribs 15 are formed on the facing surface 8*a* of the tube guide 8, it is possible to prevent (restrict) the floating of the tubes 6 when the tubes 6 come into contact with the ribs 15.

Further, since the connecting ports 3*c* of the ink jet head 3 to which the tubes 6 are connected are arranged in the paper feeding direction along the horizontal plane, the length of the ink-jet head 3 in the vertical direction can be made small.

Figure 7:
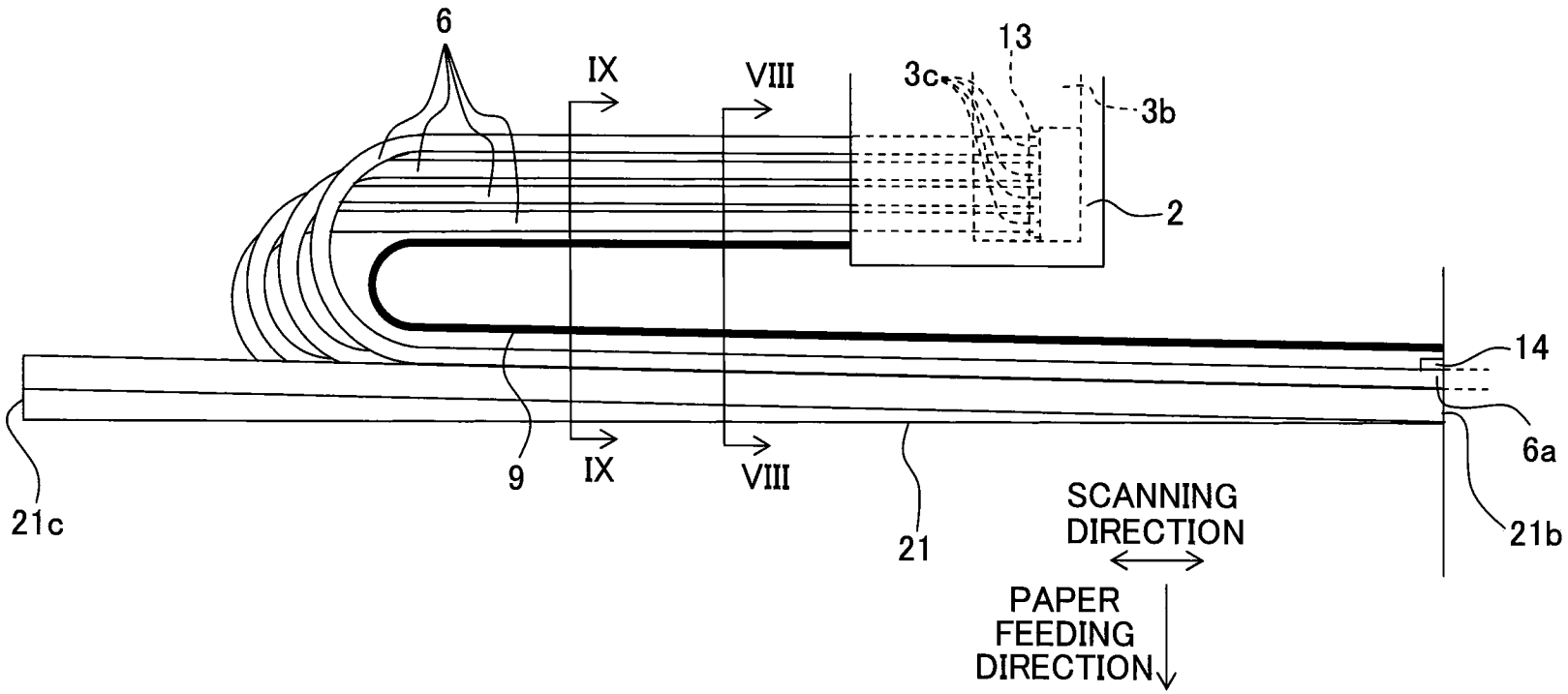
FIG. 7 is a view corresponding to FIG. 2 in a modified example 1.
Figure 8:
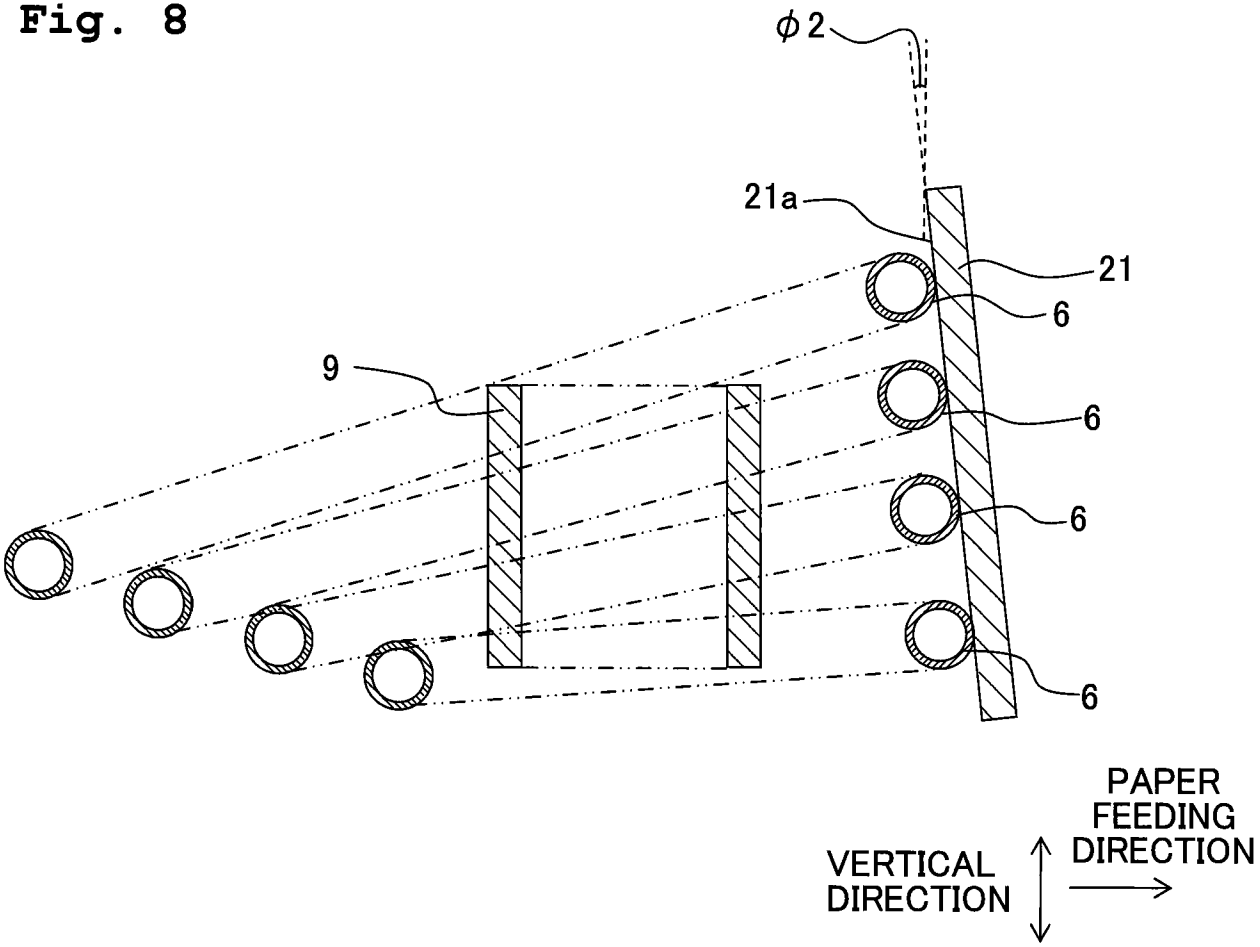
FIG. 8 is a view corresponding to FIG. 5 in the modified example 1.
Figure 9:
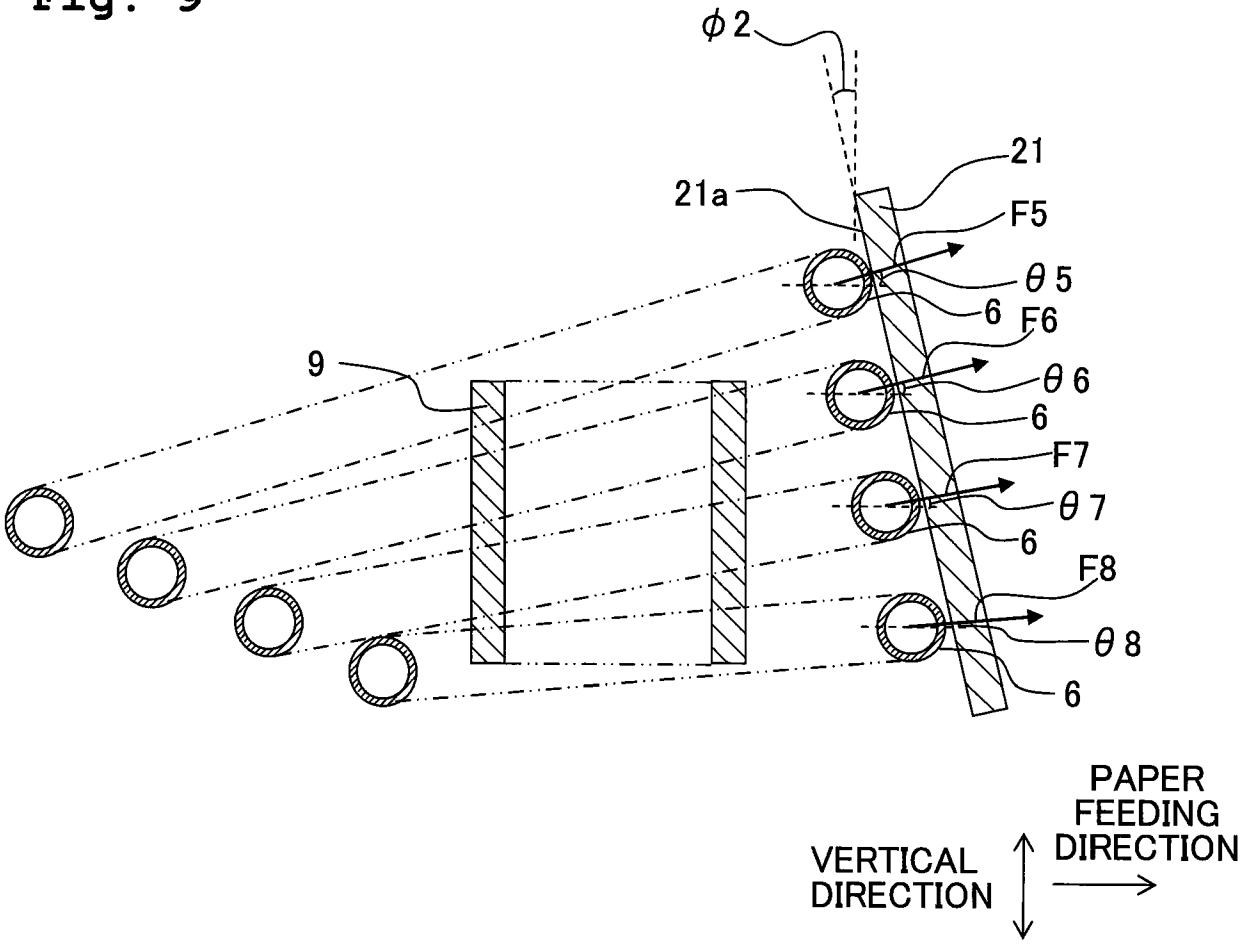
FIG. 9 is a view corresponding to FIG. 6 in the modified example 1.

Next, modified examples in which various changes are added to this embodiment will be explained. However, the same reference numerals and symbols are used to designate portions having structures similar to those of this embodiment, and explanation thereof will be omitted when appropriate, In one modified example, as shown in FIG. 7 to FIG. 9, four tubes 6 are fixed at fixed portions 6*a* in a state that the tubes 6 are arranged in a vertical direction, and a tube 6 positioned more upwardly in the vertical direction is connected to a connecting port 3*c* positioned on more upper side in FIG. 7 (more outer peripheral side of bending of the tubes 6 in a plane view). Then, at portions facing a facing surface 21*a* of a tube guide 21, the tubes 6 are arranged in a manner that the tube 6 positioned more upwardly in the vertical direction is positioned at a position on more upstream side of the paper feeding direction (the left side in FIG. 8, FIG. 9), in other words, on more inner peripheral side of the bending of the tubes 6. Further, an arrangement direction of the four tubes 6 inclines from the vertical direction to a greater extent as it goes farther from the fixed portions 6*a* in a scanning direction.

Further, when seen from a side of a second end portion 21*c* of the tube guide 21, the facing surface 21*a* of the tube guide 21 is made to be a curved surface to make a counter clockwise inclination angle ϕ2 from the vertical direction increases toward the second end portion 21*c* in the scanning direction, and the facing surface 21*a* inclines in a manner that an upper end thereof is positioned on the upstream side of the paper feeding direction (the left side in FIG. 8, FIG. 9) with respect to a lower end thereof at any portion in the scanning direction. Then, the facing surface 21*a* is parallel to the arrangement direction of the four tubes 6 in entire area thereof. Further, ribs 15 (see FIG. 5) are not formed on the facing surface 21*a* unlike the above-described embodiment (a modified example 1).

In the above case as well, the facing surface 21*a* is curved such that the inclination extent with respect to the vertical direction increases toward the second end portion 21*c* in the scanning direction, and the facing surface 21*a* is parallel to the arrangement direction of the four tubes 6 along the entire area of the tube guide 8. Therefore, there are no differences between separation distances between the respective tubes 6 and the facing surface 21*a*, and the four tubes 6 come into contact with the facing surface 21*a* at substantially the same time. Accordingly, timings, in which the respective tubes 6 collide with the facing surface 21*a* and thereby generating noises, are substantially the same, and a period of time when the above-described noises are generated becomes short.

Further, in the case when all of the fixed portions 6*a* of the four tubes 6 are positioned above the connecting ports 3*c* as described above, reaction forces F5 to F8 which intend to restore the tubes 6 from bent states to their original states, as shown in FIG. 9, act toward the upper right in FIG. 9. However, since the facing surface 21*a* inclines in a manner that the upper end is positioned on the upstream side of the paper feeding direction (the left side in the drawing), namely on the inner peripheral side of the bending of the tubes 6 with respect to the lower end at any portion in the scanning direction, intersecting angles with the facing surface 21*a* and the reaction forces F5 to F8 become large compared with the case when the facing surface is in the vertical direction.

Therefore, compared with the case of the above-described embodiment and the case when the facing surface is in the vertical direction all along the area thereof, components of the reaction forces F5 to F8 in a direction perpendicular to the facing surface 21*a* become large and components of the reaction forces F5 to F8 in a direction parallel to the facing surface 21*a* become small, resulting that the tubes 6 hardly float (hardly move parallel to the facing surface 21*a*). Accordingly, in the modified example 1, although the ribs 15 (see FIG. 5) are not formed on the facing surface 21*a*, it is possible to prevent the tubes 6 from floating.

Note that in the modified example 1 as well, in the case when diameters of the tubes 6 are large and reaction forces to be generated in the tubes 6 by being bent are large, similarly to the above-described embodiment, the ribs 15 (see FIG. 5) may also be formed on the facing surface 21*a*. On the other hand, in the case when diameters of the tubes 6 are small and reaction forces to be generated in the tubes 6 by being bent are small, similarly to the modified example 1, the ribs 15 do not have to be formed on the facing surface 8*a* in the above-described embodiment.

Further, in the case when the ribs 15 are formed on the facing surfaces 8*a*, 21*a*, the ribs 15 are not limited to the case of being formed correspondingly to the four tubes 6 one by one, and if only the rib 15 is formed at least above the tube 6 positioned uppermost, it is possible to prevent the four tubes 6 from floating in the direction parallel to the facing surface.

Further, in this embodiment, the whole area of the facing surface 8*a* is made to be the curved surface inclined with respect to the vertical direction to be parallel to the arrangement direction of the tubes 6, but the present invention is not limited to the above. The facing surface of the tube guide may incline with respect to the vertical direction in a manner that at the second end portion, the facing surface is parallel to the arrangement direction of the tubes 6 at portions facing to the second end portion, and other portions may extend in the vertical direction.

The arrangement direction of the four tubes 6 inclines with respect to the vertical direction to the largest extent at portions that are farthest from the fixed portions 6*a* in the scanning direction among the portions facing to the facing surface of the tube guide. However, if the facing surface of the tube guide inclines with respect to the vertical direction only at the second end portion and is parallel to an arrangement direction of the tubes 6 at the portions facing the second end portion of the facing surface, there are no differences between separation distances between the respective tubes 6 and the facing surface at the above portions, and the four tubes 6 come into contact with the facing surface at substantially the same time. Accordingly, timings, in which the respective tubes 6 collide with the second end portion of the facing surface and thereby generating noises, become substantially the same, and a period of time when the above-described noises are generated can be made short. Namely, since the tubes are arranged along a virtual plane (second plane) which is intersecting with the horizontal plane in the vicinity of the second end portion, the facing surface may incline in the vicinity of the second end portion with respect to the vertical direction such that the facing surface is parallel to the virtual plane in the vicinity of the second end portion.

Note that, at portions of the tubes which are different from the above-described portions facing the facing surface, an inclination of the arrangement direction of the tubes 6 with respect to the vertical direction is not so large, and therefore there is no case that the timings, in which the tubes 6 collide with the facing surface and thereby generating noises, are greatly different.

Figure 10:
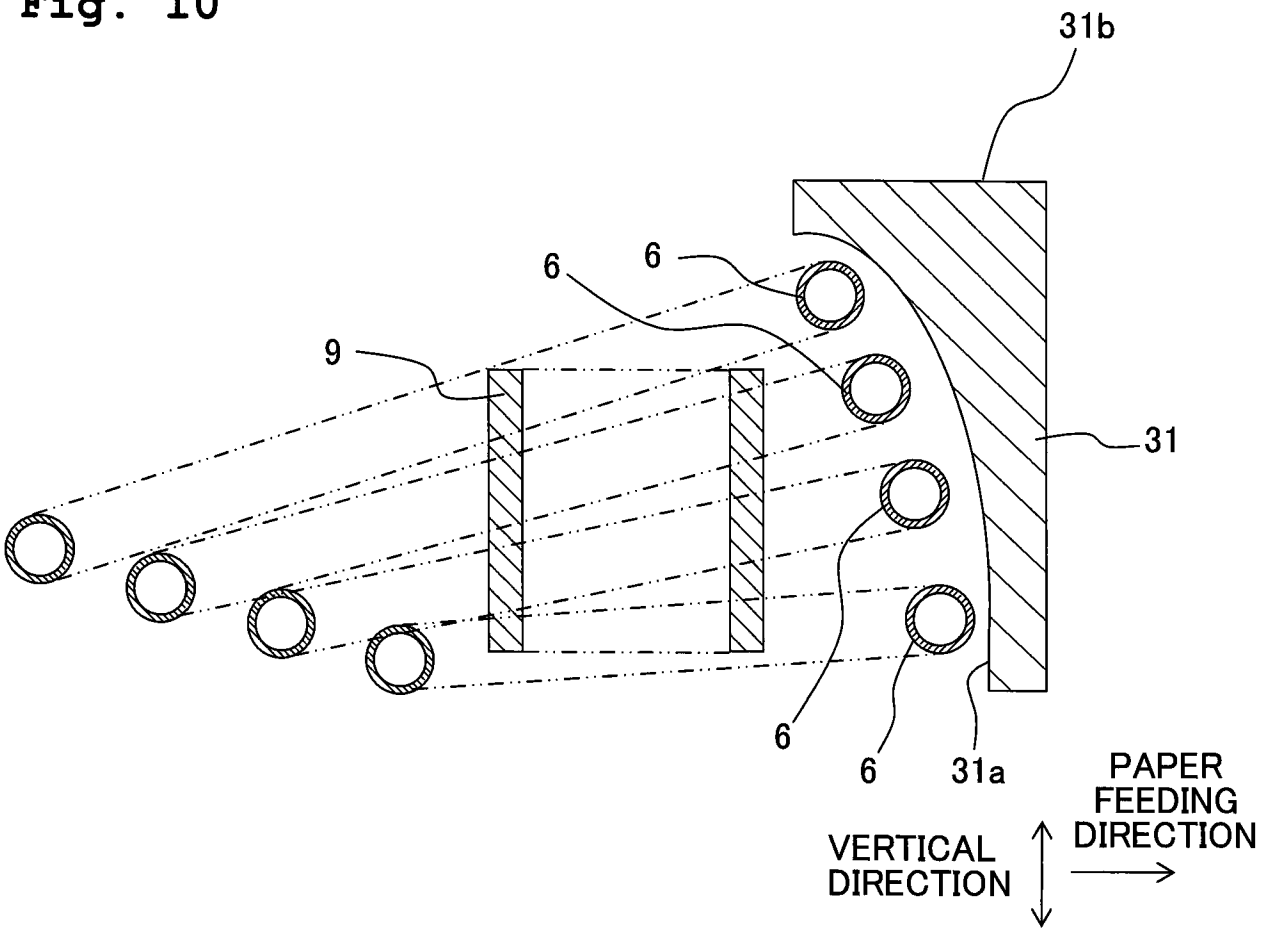
FIG. 10 is a view corresponding to FIG. 5 in a modified example 2.

Further, as shown in FIG. 10, a tube guide 31 (regulating member) may have a cross-sectional shape which is perpendicular to the scanning direction such that the tube guide 31 projects toward the upstream side of the paper feeding direction to a greater extent and a width in a paper feeding direction becomes greater as a portion of the tube guide 31 is positioned higher in a vertical direction. In other words, width of the cross-sectional shape in the paper feeding direction increases toward uppermost portion 31*b* of the tube guide 31 (a modified example 2). According to the above-described tube guide 31, as for a cross section with respect to the scanning direction, a facing surface 31*a* is curved toward the more upstream side of the paper feeding direction, namely more inner peripheral side of bending of tubes 6 as a portion of the, facing surface 31*a* is positioned higher in the vertical direction, and is made substantially parallel to an arrangement direction of the four tubes 6. Therefore, an effect similar to that of the above-described modified example 1 can be obtained.

Further, in this embodiment, the four tubes 6 are connected to the connecting ports 3*c* in the ink-jet head 3 in a state that the tubes 6 are arranged in the paper feeding direction, and are fixed at the fixed portions 6*a* in a state that the tubes 6 are arranged in the vertical direction, thereby being in the twisted state. However, if the tubes 6 are disposed in the twisted state, the arrangement direction of the tubes 6 at the connection ports in the ink-jet head may be the scanning direction or the direction parallel to the horizontal plane different from, the paper feeding direction and the scanning direction, and furthermore may be the direction intersecting with the horizontal plane. Further, the arrangement direction of the tubes 6 at the fixed portions may be a direction different from the vertical direction.

If a plurality of tubes are disposed in a twisted state, an arrangement direction of the tubes inclines from an arrangement direction of the tubes at fixed portions, at portions facing a facing surface of a tube guide between an ink-jet head and the fixed portions. However, by making the facing surface incline to be parallel to the arrangement direction of the tubes as described above, differences between separation distances between the respective tubes and the facing surface are decreased, and the four tubes come into contact with the facing surface at substantially the same time. Accordingly, timings, in which the respective tubes collide with the facing surface of the tube guide and thereby generating noises, are substantially the same, and a period of time when the above-described noises are generated can be made short.

Note that in this embodiment, the second direction means the paper feeding direction in FIG. 1, namely the direction parallel to the horizontal plane and perpendicular to the first direction, but the second direction only needs to be a direction parallel to the horizontal plane, and may be the first direction.

Further, in this embodiment, the number of the tubes 6 is four, but the number of the tubes 6 may be two, three, or equal to or more than five.

Further, in the above explanation, there is explained an example in which the present invention is applied to the printer performing printing on the recording paper P by jetting the inks from the nozzles 10 moving in the scanning direction with the carriage 2, but it is also possible to apply the present invention to a liquid jetting apparatus moving in a scanning direction and jetting liquid other than ink from nozzles.

What is claimed is:

1. A liquid jetting apparatus which jets a liquid, comprising:

a liquid jetting head which reciprocates in a first direction on a first plane and which jets the liquid from a nozzle;

liquid supply sources which store the liquid to supply to the liquid jetting head;

a plurality of flexible tubes, wherein:

each of the flexible tubes constructs a part of a liquid flow passage from one of the liquid supply sources to the liquid jetting head;

the flexible tubes are fixed to the liquid jetting apparatus at predetermined fixed portions which are different from connecting portions of the tubes at which the tubes are connected to the liquid jetting head respectively;

the flexible tubes are arranged in a state that the tubes are bent and twisted at portions between the connecting portions and the fixed portions; and the flexible tubes have extending portions extending from the fixed portions to the portions at which the tubes are bent and twisted respectively; and a regulating member which is arranged at a position on an outer peripheral side of a bending direction of the tubes to regulate movement of the tubes in a second direction, on the first plane, perpendicular to the first direction, caused by bending of the tubes, and which has a facing surface facing the extending portions of the tubes and extending in the first direction;

wherein the facing surface has a first end portion which is located in the vicinity of the fixed portions of the tubes and a second end portion which is opposite to the first end portion in the first direction;

wherein the facing surface regulates the movement of the tubes in the second direction;

wherein the tubes are arranged along a second plane which is intersecting with the first plane in the vicinity of the second end portion; and wherein the facing surface inclines in the vicinity of the second end portion with respect to a direction perpendicular to the first plane such that the facing surface is parallel to the second plane in the vicinity of the second end portion.

2. The liquid jetting apparatus according to claim 1, further comprising:

a fixing member which fixes the fixed portions of the tubes to the liquid jetting apparatus.

3. The liquid jetting apparatus according to claim 1;

wherein each of the fixed portions is formed in one of the tubes at an intermediate portion thereof.

4. The liquid jetting apparatus according to claim 1;

wherein the fixed portions are fixed to the regulating member.

5. The liquid jetting apparatus according to claim 1;

wherein the facing surface is twisted such that an inclination extent by which the facing surface is inclined with respect to the arrangement direction of the tubes at the fixed portions is increased toward the vicinity of the second end portion in the first direction, and the tubes are arranged along the facing surface at any portion of the facing surface in the first direction.

6. The liquid jetting apparatus according to claim 1;

wherein the regulating member extends in the first direction and vertical direction, and has a cross section which is perpendicular to the first direction and of which width in the second direction increases toward uppermost portion of the regulating member.

7. The liquid jetting apparatus according to claim 5;

wherein ribs which regulate movement of the tubes in a direction intersecting with the first plane are formed on the facing surface.

8. The liquid jetting apparatus according to claim 7;

wherein the liquid jetting head has a plurality of connecting ports which are arranged in the second direction along the first plane and to which the tubes are connected; and wherein the fixed portions of the tubes are located at positions different from positions of the connecting ports of the liquid jetting head with respect to the second direction, and the tubes are fixed at the fixed portions in a state that the tubes are arranged in the direction perpendicular to the first plane.

9. The liquid jetting apparatus according to claim 1;

wherein the tubes have same lengths.

10. The liquid jetting apparatus according to claim 9;

wherein the tubes extend in the first direction from the fixed portions and each of the tubes is bent back in a U-shape at an intermediate portion thereof.

11. The liquid jetting apparatus according to claim 10;

wherein as the liquid jetting head comes closer to an end portion, on a side of the second end portion of the facing surface, in a moving range in the first direction, a contact area of each of the tubes with the facing surface in the first direction increases.

* * * * *